US009327291B2

(12) United States Patent
Brodt

(10) Patent No.: US 9,327,291 B2
(45) Date of Patent: May 3, 2016

(54) UNDERWATER MINERAL DRESSING METHODS AND SYSTEMS

(71) Applicant: S.G.B.D. TECHNOLOGIES LTD., Haifa (IL)

(72) Inventor: Alexander Brodt, Beer Sheva (IL)

(73) Assignee: S.G.B.D. TECHNOLOGIES LTD., Haifa (IL)

( * ) Notice: Subject to any disclaimer, the term of this patent is extended or adjusted under 35 U.S.C. 154(b) by 466 days.

(21) Appl. No.: 13/950,329

(22) Filed: Jul. 25, 2013

(65) Prior Publication Data

US 2015/0021421 A1 Jan. 22, 2015

(30) Foreign Application Priority Data

Jul. 18, 2013 (IL) ..... 227550

(51) Int. Cl.

| | |
|---|---|
| ***B02C 23/36*** | (2006.01) |
| ***B03B 7/00*** | (2006.01) |
| ***B03B 5/36*** | (2006.01) |
| ***B02C 23/08*** | (2006.01) |
| ***B02C 4/02*** | (2006.01) |
| ***B03B 11/00*** | (2006.01) |

(52) U.S. Cl.

CPC ... *B03B 7/00* (2013.01); *B02C 4/02* (2013.01); *B02C 23/08* (2013.01); *B02C 23/36* (2013.01); *B03B 5/36* (2013.01); *B03B 11/00* (2013.01); *B03B 2011/008* (2013.01)

(58) Field of Classification Search

CPC ..... B03B 7/00; B03B 11/00; B03B 5/36; B03B 2011/008; B02C 4/02; B02C 23/08; B02C 23/36

USPC ..... 241/46.02, 46.06, 46.15, 20, 79.1, 81

See application file for complete search history.

(56) References Cited

U.S. PATENT DOCUMENTS

| | | | | |
|---|---|---|---|---|
| 626,865 | A * | 6/1899 | Johnson | B03B 9/061 209/235 |
| 1,349,221 | A * | 8/1920 | Nolen | B02C 4/32 241/159 |
| 2,105,597 | A * | 1/1938 | Hoyt | B03B 9/00 209/3 |

(Continued)

FOREIGN PATENT DOCUMENTS

RU 2043500 9/1995

OTHER PUBLICATIONS

Shilo N.A. "Fundamentals of Alluvial Deposits", Moscow: Nauka, 1981, 384 pp.

(Continued)

*Primary Examiner* — Mark Rosenbaum

(74) *Attorney, Agent, or Firm* — Pearl Cohen Zedek Latzer Baratz LLP

(57) ABSTRACT

Underwater mineral dressing units, systems and methods are provided. Material is milled in a water-immiscible liquid which is heavier than water and lighter than the product material. Gangue material is removed by the milling and floats on the water-immiscible liquid to be removed without further processing. Product containing material sinks and is further milled to remove additional gangue material, until the required level of extraction is achieved. Cascades of milling rolls in the water-immiscible liquid allow ever improving extraction of the product material. The rolls are arranged to regulate material flow through the system to remove floating gangue while directing sinking product material to further processing.

20 Claims, 4 Drawing Sheets

(56) References Cited

U.S. PATENT DOCUMENTS

| | | | | |
|---|---|---|---|---|
| 2,446,772 | A * | 8/1948 | Laughlin | E02B 8/026 210/173 |
| 4,232,903 | A | 11/1980 | Welling et al. | |
| 6,003,952 | A | 12/1999 | Smart et al. | |
| 7,875,123 | B2 | 1/2011 | Crawford | |
| 8,328,126 | B2 * | 12/2012 | Bruggencate | B02C 4/02 241/236 |
| 2015/0047388 | A1 * | 2/2015 | Brodt | C02F 1/22 62/536 |

OTHER PUBLICATIONS

Office Action for Israeli Application No. 227550 dated Mar. 2, 2014.

* cited by examiner

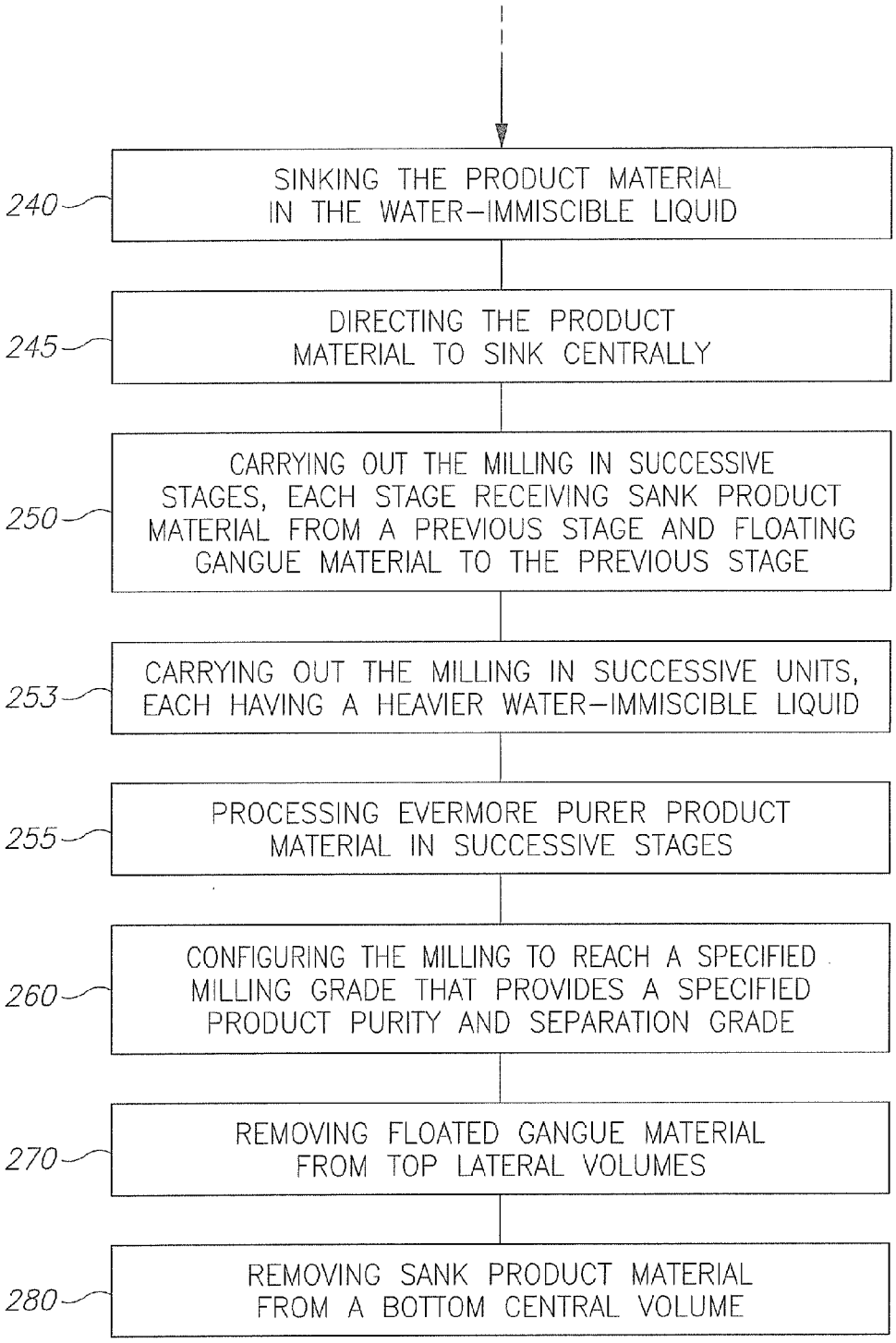
Figure 3 (cont. 1)

UNDERWATER MINERAL DRESSING METHODS AND SYSTEMS

CROSS REFERENCE TO RELATED APPLICATIONS

This application claims the benefit of Israeli Patent Application No. 227550, filed on Jul. 18, 2013, which is incorporated herein by reference in its entirety.

BACKGROUND OF THE INVENTION

1. Technical Field

The present invention relates to the field of ore extraction, and more particularly, to underwater mineral dressing.

2. Discussion of Related Art

Mineral dressing is the extraction and processing of mineral ores from the rock material in which they are embedded. Underwater mineral dressing is much more difficult than mineral dressing on land or in mines, as the minerals are usually associates with huge amounts of unneeded rock material.

SUMMARY OF THE INVENTION

One aspect of the present invention provides an underwater mineral dressing unit comprising: a vertical vessel comprising at least one pair of a flow compartment and a milling compartment, wherein the flow compartment is positioned above and in fluid communication with a milling compartment; and a water-immiscible liquid filling the vertical vessel and selected to have a density that is intermediate between lighter gangue material and heavier product material, to float the gangue material and to sink the product material, wherein the milling compartment comprises grinding rolls configured to receive material from the flow compartment into a volume between the rolls and direct the floating gangue material back to the flow compartment via lateral volumes with respect to the rolls.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the some may be carried into effect, reference will now be made, purely by way of example, to the accompanying drawings in which like numerals designate corresponding elements or sections throughout.

In the accompanying drawings.

DETAILED DESCRIPTION OF THE INVENTION

Figure 1:
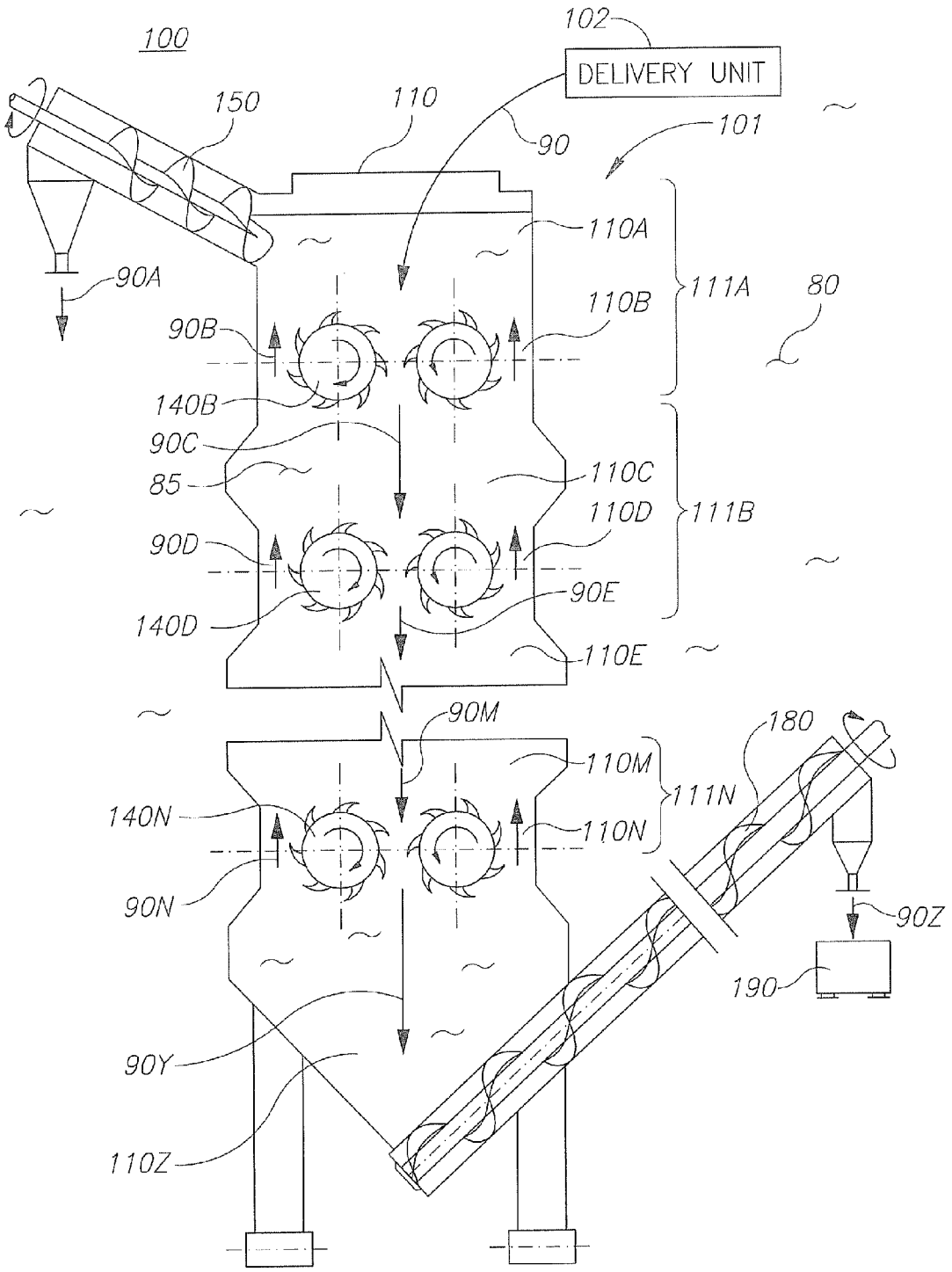
FIG. 1 is a high level schematic illustration of an underwater mineral dressing unit and system according to some embodiments of the invention.

Prior to the detailed description being set forth, it may be helpful to set forth a definition of the term "gradient" as used in this application, which refers to a monotonous increase which may be continuous or step-wise. As an example, a liquid density gradient may comprise a gradual increase in density or several layers, each layer with a higher density than the layer above it.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

In underwater mineral dressing units, systems and methods which are provided herein, material is milled in a water-immiscible liquid which is heavier than water and lighter than the product material. Gangue material is removed by the milling and floats on the water-immiscible liquid to be removed without further processing. Product containing material sinks and is further milled to remove additional gangue material, until the required level of extraction is achieved. Cascades of milling rolls in the water-immiscible liquid allow ever improving extraction of the product material. The rolls are arranged to regulate material flow through the system to remove floating gangue while directing sinking product material to further processing.

FIG. 1 is a high level schematic illustration of an underwater mineral dressing unit 101 and system 100 according to some embodiments of the invention.

Underwater mineral dressing unit 101 comprises a vertical vessel 110 comprising at least one pair (e.g., 111A) of a flow compartment and a milling compartment (e.g., flow compartment 110A and milling compartment 110B). Flow compartment (e.g., 110A) is positioned above and in fluid communication with milling compartment (e.g., 110B).

In certain embodiments, unit 101 may comprise a plurality of successive pairs (111A, 111B . . . 111N) positioned one above the other and in fluid communication. For example, FIG. 1 illustrates a succession, from top to bottom, of: flow compartment 110A, milling compartment 110B, flow compartment 110C, milling compartment 110D, flow compartment 110E etc. until flow compartment 110M and milling compartment 110N. The last compartment may be followed by a bottom compartment 110Z. The number of successive stages 111 is adapted to the required process, as explained below.

Vertical vessel 110 is filled with a water-immiscible liquid 85 selected to have a density that is intermediate between lighter gangue material and heavier product material, to float the gangue material (e.g., 90B) and to sink the product material (e.g., 90C). In case unit 101 comprises multiple successive pairs (111A, 111B . . . 111N), each pair is configured to sink the product material (e.g., 90C, 90E . . . 90M, 90Y) to a lower pair and float gangue material (e.g., 90B, 90D . . . 90N)

to an upper pair. The term "product material" as used in the present application refers to material which contains minerals which are heavier than the surrounding material, which is referred to as "gangue material" in this application. It should be noted, that the concentration of the product material increases through unit 101, as the product material advances from compartment to compartment down vessel 110, and is sequentially stripped from more and more gangue material. Hence the distinction between product material and gangue material is a functional one, as obviously the product material from one compartment (e.g., 90C exiting 110B) contains a significant amount of gangue material (e.g., 90D) which is separated in the next compartment (e.g., 110D). As the separation proceeds, the remaining product material becomes heavier as the ratio of heavy minerals to lighter gangue increases.

Water-immiscible liquid 85 may comprise a single liquid with a constant density or a liquid column that exhibits a density gradient. The density gradient may comprise a downwards increasing density, which may increase continuously or step-wise. For example, the Density gradient may comprise several layers of different liquids, each having a higher density than liquids above it. Thus, the column may be stably layered. For example, water-immiscible liquid 85 may comprise organic liquids, halogenated organic liquids or mixtures thereof prepared to reach the required density. In the non-limiting example presented below, tribromofluoromethane $CBr_3F$) is used as water-immiscible liquid 85. Other possibilities comprise bromoform ($CHBr_3$), tetrabromoethane ($C_2H_2Br_4$), pentabromofluoroethane ($C_2Br_5F$), and their mixtures and mixtures with tribromofluoromethane. Generally, other chemically inert halogenated organic compounds with appropriate rheological, thermodynamic and hygiene and sanitary properties according to specifications may be used as water-immiscible liquid having the density intermediate between those of the target component and waste rock.

Depending on the density of the gangue material, lighter water-immiscible liquid 85 may also be used, as long as they are heavier than seawater 80, e.g., phthalic acid dibutyl ether (dibutylphthalate, density 1.05 g/cm$^3$) or a mixture of various individual organic compounds (e.g., hexane mixture with perfluorocyclobutane).

The milling compartment (e.g., 110B) comprises grinding rolls (e.g., 140B) which are configured to receive material (e.g., 90) from the flow compartment (e.g., 110A) into a volume between the rolls and direct the floating gangue material (e.g., 90B) back to the flow compartment via lateral volumes with respect to the rolls.

In case unit 101 comprises multiple successive pairs (111A, 111B . . . 111N), milling roles (140B, 140D . . . 140N respectively) are configured to receive material (90, 90C . . . 90M respectively) from the respective flow compartments (110A, 110C . . . 110M respectively) into a volume between the rolls and direct the floating gangue material (90B, 901 . . . 90N respectively) back to the respective flow compartments (110A, 110C . . . 110M respectively) via lateral volumes with respect to the rolls (140B, 140D . . . 140N respectively).

Figure 2A:
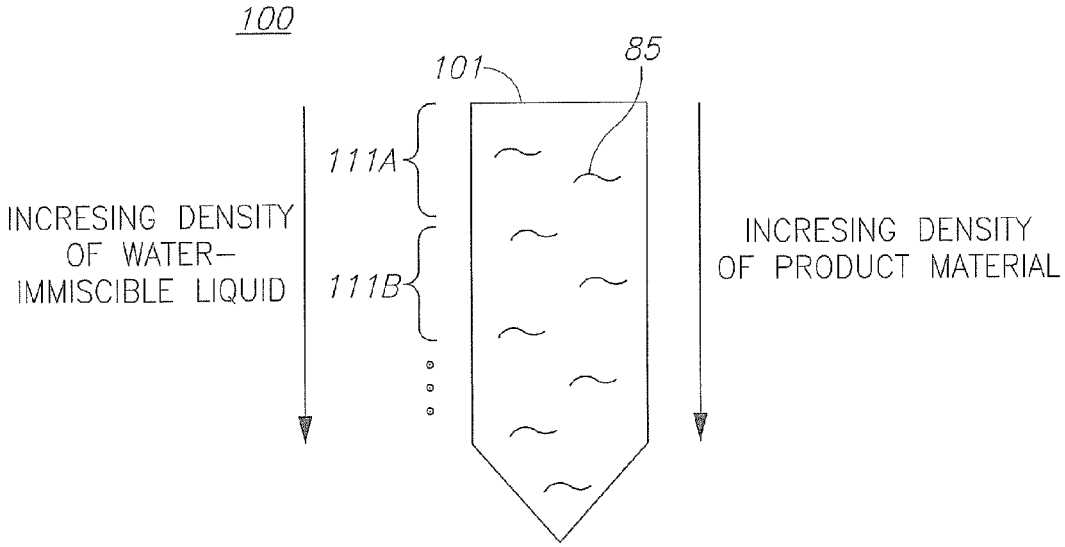
FIGS. 2A and 2B are high level schematic illustrations of configurations of system according to some embodiments of the invention.
Figure 2B:
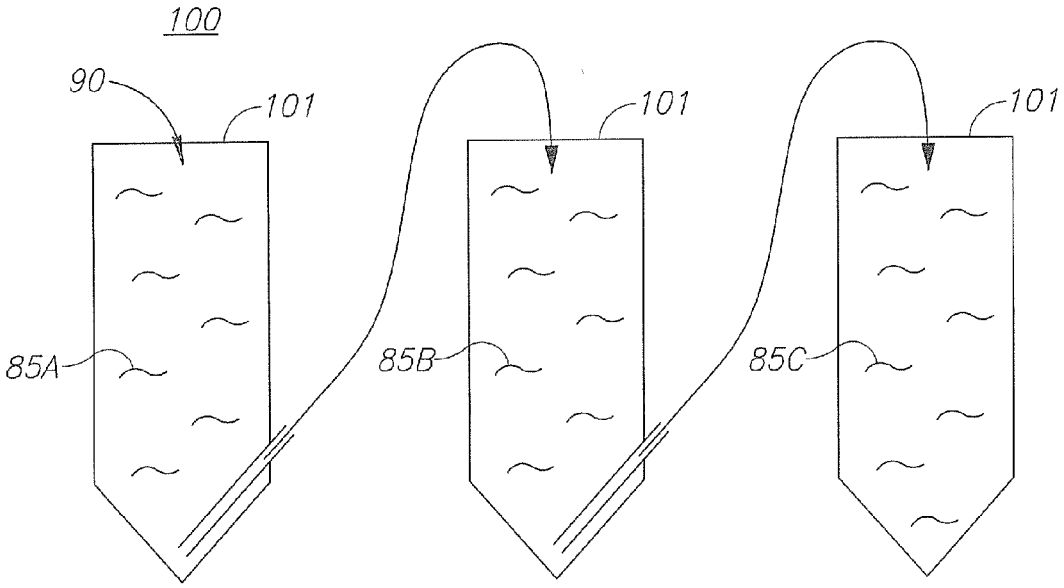

FIGS. 2A and 2B are high level schematic illustrations of configurations of system 100 according to some embodiments of the invention. FIG. 2A illustrates system 100 having unit 101 with a downwards increasing density of water-immiscible liquid. FIG. 2B illustrates system 100 having several units 101, each with water-immiscible liquids 85A, 85B, 85C having increasing densities to successively increase the level of mineral separation. Both configurations are explained below in more detail.

Without being bound by theory, the product material hence builds a density gradient of downwards increasing density from lighter product material 90C through intermediately dense product materials 90E . . . 90M to heaviest product material 90Y. In certain embodiments, the density differences of water-immiscible liquid 85 may be configured to correspond to the density gradient of the sank product material along vertical vessel 110.

Embodiments of the invention comprise underwater mineral dressing system 100. System 100 comprises underwater mineral dressing unit 101, further comprising bottom compartment 110Z positioned below and in fluid communication with bottom milling compartment 110N. Bottom compartment 110Z is arranged to receive sank product material 90Y from bottom milling compartment 110N.

System 100 may further comprise a delivery unit 102 arranged to deliver material 90 to top flow compartment 110A of pair 111A. System 100 may further comprise a top discharger 150 in fluid communication with top flow compartment 110A of pair 111A and arranged to remove the floated gangue material 90B therefrom as tailings 90A. System 100 may further comprise a bottom discharger 180 in fluid communication with bottom compartment 1102 and arranged to remove sank product material 90Y therefrom as product 90Z and, e.g., store final product 90Z in a product container 190.

Advantageously, the invention expands the processable source of raw materials at the expense of minerals bedded on the sea bottom both in gravel and native deposits, to increase the process productivity, to reduce power consumption and to decrease the removal of heavy medium out of the technological process. This is achieved by stratification of minerals constituting the rock mass in a heavy liquid with the density exceeding that of sea water and processing the rock mass in a sea-water-immiscible non-aqueous liquid. In certain embodiments, the stratification of minerals constituting the rock mass in the heavy liquid is alternated with the destruction of the target component accretions with the waste rock realized in the same liquid with the density intermediate between them. As a result, it is possible to remove rock cuts which do not contain a significant amount of heavier ores (and are hence lighter) at an earlier stage of the dressing process, and avoid wasting energy on grinding such material. Then, the dressing products wetted with non-aqueous liquid are dragged through sea water, and the non-aqueous liquid phase washed off their surface by sea water is returned to the head of the process.

In certain embodiments, a combination of stratification of minerals forming the rock mass in water-immiscible heavy organic liquid with step-by-step reduction of their coarseness in the same non-aqueous medium allows the sea-bottom processing of not only raw minerals extracted out of friable deposits, but also that produced from beds of cemented and native rocks of any strength with an arbitrarily small fineness of mutual dispersion of their components. Since the destruction of accretions of the target component with waste rock is performed in the liquid with the density intermediate between theirs, the waste rock released as the coarseness of such poly-mineral formations is reduced. Dressing of coarse rock that is devoid of heavier minerals is prevented by floating such material out of the zone of milling bodies impact. This prevents unnecessary power consumption for further destruction of the material that does not need further reduction of coarseness any more. The combination of the working medium immiscibility with sea water and the resulting maintenance of its density at a strictly constant level not only ensures a high and stable intensity of the dressing process, but also prevents an irreversible removal of such non-aqueous working liquid out of such a highly-efficient and, at the same time, ecologically clean underwater dressing process.

Figure 3:
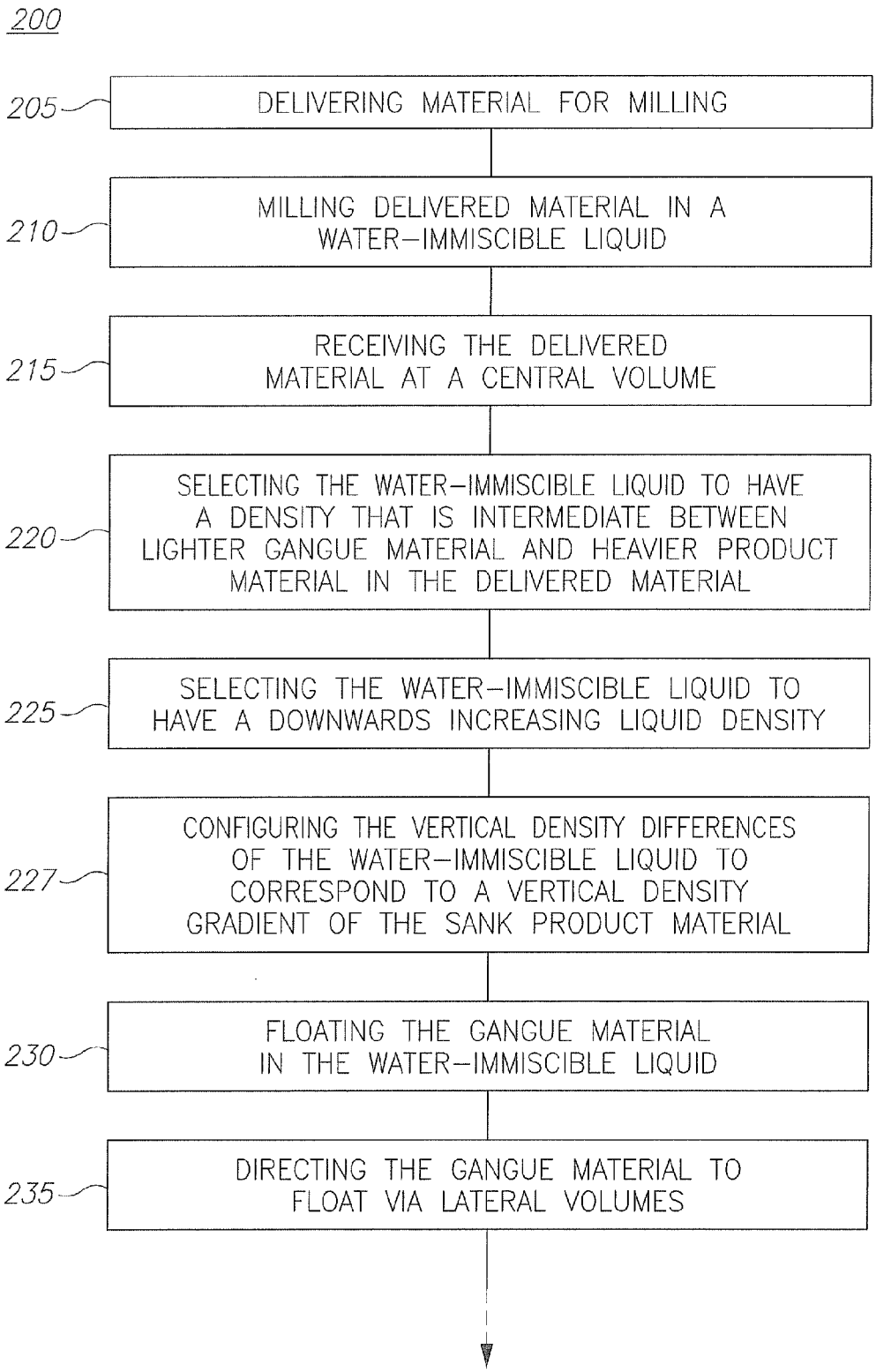
FIG. 3 is a high level schematic flowchart of a method of underwater mineral dressing, according to some embodiments of the invention.

FIG. 3 is a high level schematic flowchart of a method 200 of underwater mineral dressing, according to some embodiments of the invention.

Method 200 comprises at least some of the following stages: delivering material for milling (stage 205), milling delivered material in a water-immiscible liquid (stage 210), selecting the water-immiscible liquid to have a density that is intermediate between lighter gangue material and heavier product material in the delivered material (stage 220), and configuring the milling to receive the delivered material at a central volume (stage 215) and to float the gangue material in the water-immiscible liquid (stage 230) and direct the floating gangue material via lateral volumes (stage 235). Method 200 may further comprise sinking the product material in the water-immiscible liquid (stage 240) and directing the product material to sink centrally (stage 245). In certain embodiments, method 200 further comprises configuring the milling to reach a specified milling grade that provides a specified product purity and separation grade (stage 260).

In certain embodiments, method 200 further comprises carrying out the milling in successive stages, each stage receiving sank product material from a previous stage and floating gangue material to the previous stage (stage 250) and processing ever more purer product material in successive stages (stage 255).

In certain embodiments, method 200 may further comprise removing floated gangue material from top lateral volumes (stage 270) and removing sank product material from a bottom central volume (stage 280).

In certain embodiments, method 200 further comprises selecting the water-immiscible liquid to exhibit a constant density. In certain embodiments, method 200 further comprises selecting the water-immiscible liquid to exhibit a downwards increasing density (stage 225) and configuring the vertical density gradient of the water-immiscible liquid to correspond to a vertical density gradient of the sank product material (stage 227).

In certain embodiments, method 200 may be realized by step-by-step accomplishment of the following main technological operations. Method 200 may begin with the delivery of rock mass produced from an underwater deposit for processing into movable vertical vessel 110 with heavy organic liquid 85, which is located in the immediate vicinity of an underwater mining face. Vessel 110 may be subdivided in the vertical dimension into a cascade of compartments, where the separation of minerals forming the initial raw material is combined each time with the reduction of the coarseness of the material.

Method 200 may further comprise discharging of waste rock floating non-aqueous heavy liquid 85 from the uppermost compartment by dragging the floating waste rock through a sea-water layer, with a subsequent placement of final tailings 90A of dressing wetted with sea water in the underwater worked-out space. During the discharge, liquid 85 is separated from seawater 80 due to its immiscibility and density.

Method 200 may further comprise discharging of the valuable component extracted from the produced raw material (i.e., product 90Y) by passing the product through sea water 80 from the bottommost compartment of the vertical container with heavy organic liquid. During the discharge, liquid 85 is separated from seawater 80 due to its immiscibility and density. The removed valuable component 90Z may be stored on the sea bottom and subsequently lifted to the board of a commercial ship.

In certain embodiments, method 200 further comprises carrying out the milling in successive units, each successive unit having a heavier water-immiscible liquid than a preceding unit (stage 253).

EXAMPLE

As a non-limiting example, units 101, systems 100 and methods 200 are demonstrated for the development of underwater wolframite deposits. The density of wolframite (the product material) is 7.5 g/cm$^3$, whereas the density of quartz, the main waste component (the gangue material) of the wolframite ore, is 2.6 g/cm$^3$. In other examples, systems 100 and methods 200 may be used to dress additional ores or minerals such as diamonds, gold, platinum, iridium, tungsten, lead, nickel, copper, titanium, cobalt, niobium, tantalum, uranium, thorium, lanthanum, etc. These can be extracted on their own or as byproducts of the main dressed ore, as explained below.

The initial rock mass 90 produced in underwater sea face is continuously introduced by a central axial pipe (not shown, see arrow associated with 90) into the first, uppermost compartment 110A of movable underwater dressing plant 110 made in the form of a vertical vessel representing a chain of alternating separation and milling compartments. The dressing plant is flooded with tribromo-fluoromethane—water-immiscible halogenated organic liquid 85 (density ~2.7 g/cm$^3$).

Generally, pure quartz initially contained in wolframite ore and its debris may be removed prior to milling, e.g., by gravitational separation in water-immiscible liquid 85 in compartment 110A, before reaching first milling compartment 110B. Quartz may remain afloat in non-aqueous liquid 85, while wolframite fractions and its accretions with waste rock are submerged into the next, milling compartment 110B equipped with rollers 140B, where the first stage of the reduction of coarseness of this material takes place.

Waste product of such underwater dressing process that accumulates on the surface of heavy organic liquid 85 is discharged outwards by screw discharger 150 and (tribromofluoromethane 85 that wets the surface of the removed material is substituted for seawater 80 in the course of its dragging within the body of discharger 150, and flows down back into separation department 110A) used for stowage of the worked-out underwater space.

Due to counter-rotation of rollers 140B, friable flow of additionally milled material 90C leaving the gap (centra) volume) between them in compartment 110C is pushed out downwards, into the next separation compartment 110D, where the second stratification stage takes place in more quiet hydrodynamic conditions.

In next milling compartment 110D, additional portion 90D of pure quartz particles opened at the destruction of accretions by rollers 140D floats upwards (via lateral volumes, as directed by rollers 140D) from compartment 110D and divides, when approaching compartment 110B, into two flows one on each side of vessel 110 (counter-rotating rollers 1401 create horizontal flows of liquid medium directed from the center to the periphery), floating up in its peripheral near-wall zone towards compartment 110A, to the place of waste rock removal out of the process by screw discharger 150.

Heavy material remaining in mineralogically unopened form 90E is submerged from separation compartment 110D into the next milling compartment and then passes top-down through the vertical cascade of compartment pairs until nothing remains to float from the bottommost separation compartment 110Z, and only pure tungsten concentrate 90Y is accumulated on its bottom. In certain embodiments, unit 101 may be arranged to reach different purification stages of the ore, and sequential unit 101 may be part of system 100. In certain embodiments, successive units 101 may employ water-immiscible liquids 85 of increasing densities to increase the level of purity of the product.

Target product 90Y may be discharged by screw discharger 180. During the discharging process, heavy organic liquid 85 is washed off the surface of product 90Y by seawater 80 and flows back down to bottom compartment 110Z along the inner wall of screw discharger 180. Thus, the removal of heavy working liquid 85 is prevented, which, in certain embodiments, makes the underwater production cycle organized in this manner practically totally closed with respect to the heavy organic liquid used in it.

The ready tungsten concentrate 90Z may be accumulated containers 190 and lifted in it on board of a commercial ship with subsequent delivery of this cargo to the shore for further processing into metal tungsten.

Units 101, systems 100 and methods 200 have a number of advantages over known technologies of underwater minerals dressing. First, they ensure the technical possibility of an efficient separation of the valuable mineral from waste rock immediately on the sea bottom, irrespective of the form (detritus or native) of the initial mineral bedding in the underwater deposit. Thus, systems 100 and methods 200 avoid the delivery of the whole volume of the produced rock mass 90 on board of the commercial ship from the sea depth. In certain embodiments, further separation of valuable minerals from product material 90Z may be carried out on shore, or in a dedicate unit 101 build along the same principles, with appropriate water-immiscible liquid 85.

Second, the improvements are especially significant in case of rare and valuable metals and minerals such as diamonds, gold, platinum, iridium, tungsten, lead, nickel, copper, titanium, cobalt, niobium, tantalum, uranium, thorium, lanthanum, tinstone, wolframite, galena, cinnabar, monazite etc. Since the contents of such metals or minerals in the delivered material 90 amounts to several grams per ton, the weight of the cargo lifted on board of a commercial ship from the sea bottom decreases in four to five orders of magnitude. For example, at the development of underwater deposits of bedrock gold, whose content in the raw mineral is 2-10 gram per ton, the delivery of native gold (density 19.3 g/cm$^3$) free from the waste rock instead of raw ore on board of the commercial ship allows a reduction of tonnage of raw rock mass lifted from sea bottom per ton of ready product (recalculated per dry matter) from ca. 100,000-500,000 tons to one or two tons. The invention thus drastically reduces the price of sea-bottom development and allows using ordinary navy for underwater mining instead of floating platforms and expensive ships of high tonnage.

In the above description, an embodiment is an example or implementation of the invention. The various appearances of "one embodiment", "an embodiment", "certain embodiments" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Certain embodiments of the invention may include features from different embodiments disclosed above, and certain embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented In certain embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. An underwater mineral dressing unit comprising:

a vertical vessel comprising at least one pair of a flow compartment and a milling compartment, wherein the flow compartment is positioned above and in fluid communication with a milling compartment; and a water-immiscible liquid filling the vertical vessel and selected to have a density that is intermediate between lighter gangue material and heavier product material, to float the gangue material and to sink the product material, wherein the milling compartment comprises grinding rolls configured to receive material from the flow compartment into a volume between the rolls and direct the floating gangue material back to the flow compartment via lateral volumes with respect to the rolls.

2. The underwater mineral dressing unit of claim 1, comprising a plurality of successive pairs positioned one above the other and in fluid communication, each pair configured to sink the product material to a lower pair and float the gangue material to an upper pair.

3. The underwater mineral dressing unit of claim 1, wherein the water-immiscible liquid comprises at least one halogenated organic compound.

4. The underwater mineral dressing unit of claim 1, wherein the water-immiscible liquid exhibits a constant density in the vertical vessel.

5. The underwater mineral dressing unit of claim 1, wherein the water-immiscible liquid exhibits a downwards increasing density in the vertical vessel.

6. The underwater mineral dressing unit of claim 4, wherein density differences of the water-immiscible liquid are configured to correspond to a density gradient of the sank product material along the vertical vessel.

7. An underwater mineral dressing system comprising:

at least one underwater mineral dressing unit of claim 1, further comprising a bottom compartment positioned below and in fluid communication with a bottom milling compartment of the at least one pair, the bottom compartment arranged to receive the sank product material from the bottom milling compartment;

a delivery unit arranged to deliver material to a top Flow compartment of the at least one pair;

a top discharger in fluid communication with the top flow compartment of the at least one pair and arranged to remove the floated gangue material therefrom; and a bottom discharger in fluid communication with the bottom compartment and arranged to remove the sank product material therefrom.

8. The underwater mineral dressing system of claim 7, wherein the underwater mineral dressing comprises a plurality of successive pairs positioned one above the other and in fluid communication, each pair configured to sink the product material to a lower pair and float the gangue material to an upper pair.

9. The underwater mineral dressing system of claim 7, wherein the water-immiscible liquid exhibits a constant density along the vertical vessel.

10. The underwater mineral dressing system of claim 7, wherein the water-immiscible liquid exhibits downwards increasing densities in the vertical vessel and wherein density differences of the water-immiscible liquid are configured to correspond to a density gradient of the sank product material along the vertical vessel.

11. The underwater mineral dressing system of claim 7, comprising a plurality of successive underwater mineral dressing units, each unit arranged to deliver the sank product material to a following unit for further milling and separation.

12. The underwater mineral dressing system of claim 11, wherein successive units employ water-immiscible liquids of increasing density.

13. A method of underwater mineral dressing comprising:

milling delivered material in a water-immiscible liquid selected to have a density that is intermediate between lighter gangue material and heavier product material in the delivered material, to float the gangue material and to sink the product material; and configuring the milling to receive the delivered material at a central volume and direct the floating gangue material via lateral volumes.

14. The underwater mineral dressing method of claim 13, wherein the milling is configured to reach a specified milling grade that provides a specified product purity and separation grade.

15. The underwater mineral dressing method of claim 13, wherein the milling is carried out in a plurality of successive stages, wherein each successive stage is configured to receive sank product material from a previous stage and to float gangue material to the previous stage.

16. The underwater mineral dressing method of claim 13, further comprising delivering the material, removing floated gangue material from top lateral volumes and removing sank product material from a bottom central volume.

17. The underwater mineral dressing method of claim 13, further comprising selecting the water-immiscible liquid to exhibit a constant density.

18. The underwater mineral dressing method of claim 13, further comprising selecting the water-immiscible liquid to exhibit a downwards increasing density.

19. The underwater mineral dressing method of claim 18, further comprising configuring the vertical density differences of the water-immiscible liquid to correspond to a vertical density gradient of the sank product material.

20. The underwater mineral dressing method of claim 13, further comprising carrying out the milling in successive units, each successive unit having a heavier water-immiscible liquid than a preceding unit.

* * * * *